United States Patent [19]

Carpenter

[11] 4,032,157

[45] June 28, 1977

[54] GOLFER'S TRAINING DEVICE

[76] Inventor: Walter M. Carpenter, 1825 W. 38th Place, Davenport, Iowa 52806

[22] Filed: Feb. 13, 1976

[21] Appl. No.: 657,913

[52] U.S. Cl. ..... 273/183 E; 273/187 A; 273/186 C

[51] Int. Cl.² ..... A63B 69/36

[58] Field of Search ..... 273/183 R, 183 D, 183 E, 273/183 A, 183 B, 186 C, 35 R; 35/29 A, 34

[56] References Cited

UNITED STATES PATENTS

| | | | |
|---|---|---|---|
| 1,951,337 | 3/1934 | Bakst | 35/34 |
| 2,917,835 | 12/1959 | Nelson | 35/34 X |
| 3,485,497 | 12/1969 | Wilks | 273/183 E |
| 3,524,650 | 8/1970 | Brandell | 273/183 E |
| 3,779,398 | 12/1973 | Hunter | 273/183 D |

*Primary Examiner*—George J. Marlo
*Attorney, Agent, or Firm*—Henderson, Strom & Sturm

[57] ABSTRACT

A base having a lower, ground-engageable portion and an upper portion. An indicator mechanism is formed by first and second perpendicularly intersecting planar members. Each of the outer planar surfaces of the planar members includes a distinctive color, and each color is different from the others. The first planar member defines a plane oblique to the ground while the second planar member defines a plane normal to the ground. The indicator mechanism is attached to the upper portion of the base. When the golfer assumes a golfing stance adjacent the base and gazes at the indicator mechanism, the upper edges of the planar members form an inverted T-shape, the side surfaces of the planar members not being visible.

9 Claims, 7 Drawing Figures

GOLFER'S TRAINING DEVICE

BACKGROUND OF THE INVENTION

This invention relates generally to athletic equipment and particularly to instructional equipment for golfing. A number of things are crucial for good golfing. A golfer must have the correct stance when he addresses the ball, and he must have the proper swing when he strikes the ball. While a large number of devices have been developed which enable the golfer to practice striking the ball in places other than on the golf course itself, no device has been developed which enables the golfer to analyze what he is doing right or wrong concerning his stance and swing. The golfer of course can see that he has hooked, sliced or shanked the ball, but he can tell very little from this about how to change his stance or the movements which he makes during his swing. A second person such as a golf pro at the local golf club must observe the golfer and relay to the golfer comments concerning the golfer's stance and swing.

When a golfer has a proper stance and swing, his head does not move from the time he addresses the ball until after he has completed his swing. To teach the golfer to hold his head steady, a second person usually must place a hand upon the golfer's head while the golfer is practicing, and this must ordinarily be done at the golf course.

Since certain types of instruction concerning the golfer's swing really can be give only at a golf course, and since such instruction involves observations of the golfer and communication thereof to the golfer by a second person, the instructional process can be cumbersome and inconvenient. A method or device whereby the golfer is enabled to instruct himself at convenient times and locations is to be much preferred.

SUMMARY OF THE INVENTION

A self-instruct golf analyzer has a base and an indicator mechanism. The indicator mechanism includes first and second perpendicularly intersecting planar members. The indicator mechanism is affixed to the base such that the first planar member defines a plane oblique to the ground while the second planar member defines a plane normal to the ground. The upper edges of the planar members form an inverted T-shape, and the front and rear surfaces of the first planar member and the left and right surfaces of the second planar member are not visible, when the golfer has assumed a correct stance adjacent the base and is gazing at the indicator mechanism. The front, rear, left and right surfaces have different colors which, when detected by the golfer during his swing, indicate improper head and body movement.

It is an object of this invention to provide a self-instruct golf analyzer which can be used by golfers of any height with clubs of any given loft.

It is also an object of this invention to provide a self-instruct golf analyzer which will enable the golfer to practice his swing at any place or time convenient to the golfer.

Another object of this invention is to provide a self-instruct golf analyzer which will enable the golfer to detect instantly any deviation of his head, and therefore improper body movement, during his swing, and to analyze and correct his swing to attain a steady head without a second person having to be present to make observations and communications thereof.

A further object of this invention is to provide a self-instruct golf analyzer which is simple of construction and economical of manufacture yet sturdy and capable of achieving the aforementioned objects.

These objects and other features and advantages of the self-instruct golf analyzer of this invention will become readily apparent upon referring to the following description, when taken in conjunction with the appended drawing.

BRIEF DESCRIPTION OF THE DRAWING

The self-instruct golf analyzer of this invention is illustrated in the drawing wherein.

DESCRIPTION OF THE PREFERRED EMBODIMENT

Figure 1:
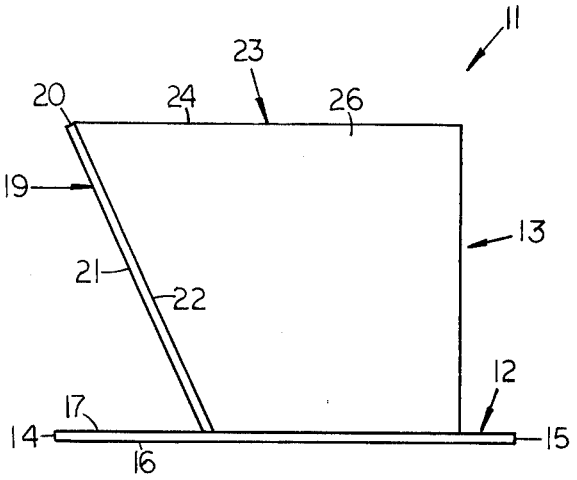
FIG. 1 is a side elevational view of the first embodiment of the analyzer of this invention.

Referring now to the drawing, the self-instruct golf analyzer of this invention is illustrated generally at 11 in FIG. 1. The analyzer 11 more particularly includes a base member 12 and an indicator mechanism 13.

Figure 2:
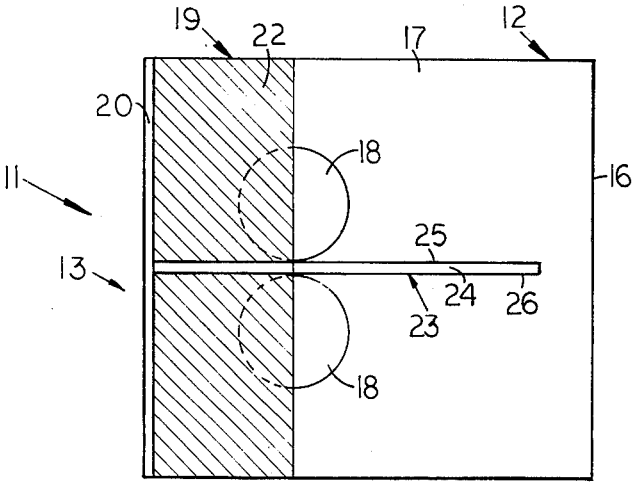
FIG. 2 is a top plan view of the first embodiment of the analyzer of this invention.
Figure 3:
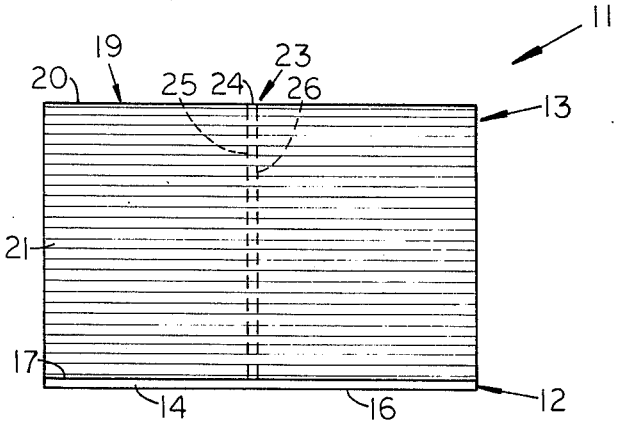
FIG. 3 is a front elevational view of the first embodiment of the analyzer of this invention.

Referring to FIGS. 1, 2 and 3, the base member 12 is flat and substantially rectangular in shape, having front and rear edge 14, 15. The base 12 may be other than rectangular in shape. The bottom surface 16 of the base 12 engages the ground or floor. The top surface 17 of the base 12 is very dark in color, preferably black. A pair of circular ball simulating areas 18, preferably white in color, are disposed upon the upper surface 17. The areas 18 are located toward the front edge 14, one area 18 being on each side of a line which is perpendicular to and bisects both edges 14, 15. The areas 18 are so oriented that the line which is defined by the centers of the areas 18 is also parallel to the front and rear edges 14, 15.

The indicator mechanism 13 includes a front, transverse plane 19. The front plane 19 at the lower edge thereof is affixed to the upper surface 17 of the base 12 directly over the line defined by the centers of the areas 18. Both areas 18 are thereby bisected by the plane 19. The front plane 19 is parallel to the front edge 14 and extends upwardly from the base 12, at an angle of about 65° from the top surface 17 as measured from that part of the surface 17 adjacent the front edge 14, to terminate in a upper edge 20. The front surface 21 of the plane 19 is a contrasting color, perhaps blue, to the black and white of the top surface 17 and areas 18. The rear surface 22 of the plane 19 is another contrasting color, perhaps green.

The indicator mechanism 13 also includes a longitudinal plane 23. The plane 23 is attached to the base 12 perpendicular to the upper surface 17 and extends upwardly therefrom to terminate in an upper edge 24. The plane 23 is attached to the base 12 directly over the line which is perpendicular to and bisects the front and rear edges 14, 15. The plane 23 also is attached to the transverse plane 19 and bisects the rear surface 22, the upper edges 20, 24 forming a T when viewed in plan (FIG. 2). The longitudinal plane 23 has left and right facing sides 25, 26. Again, these sides 25, 26 are of contrasting colors, the left side 25 being orange and the right side 26 being yellow perhaps.

The areas 18 are divided such that the front half of each area 18 is within the portion of the surface 17 extending between the front edge 14 and the intersection of the plane 19 with the surface 17. The rear half of each area 18 is within the portion of the surface 17 extending between the rear edge 15 and the intersection of the plane 19 with the surface 17. The rear halves of areas 18 are separated by the plane 23, the rear half of one area 18 being in the portion of surface 17 fronting the left side 25, and the rear half of the other area 18 being disposed in the portion of surface 17 fronting the right side 26.

Figure 5:
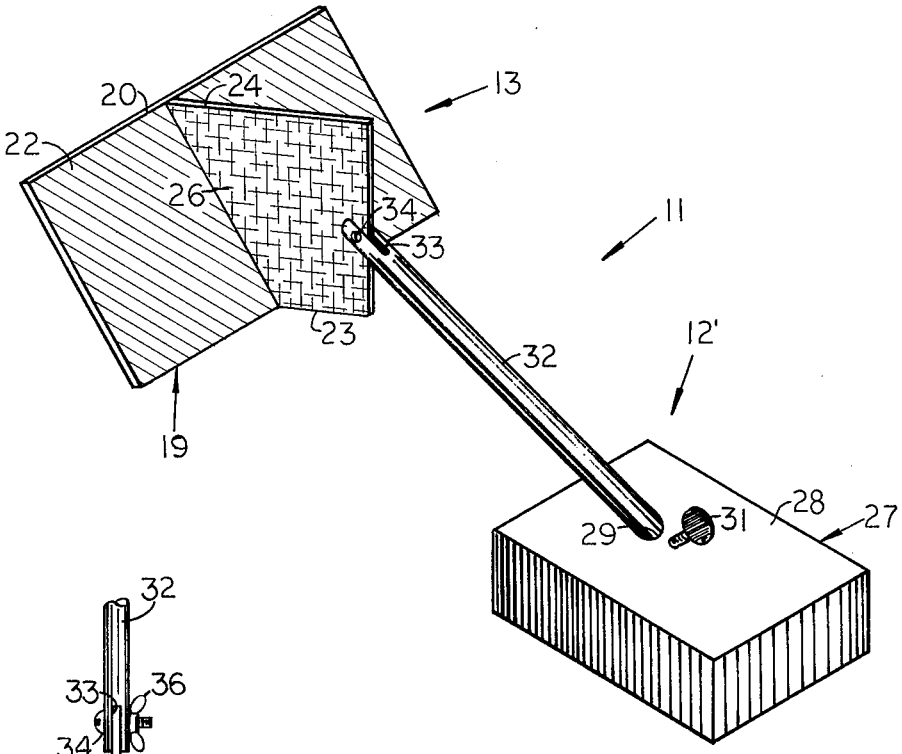
FIG. 5 is a perspective view of the second embodiment of the analyzer.

A second embodiment of the analyzer of this invention 11 is generally shown in FIG. 5. The base assembly 12' includes a block member 27 having a lowr surface which engages the ground or floor and an upper surface 28. The block 27 has a bore 29 formed therein at an angle to the surface 28. A tightening screw 31 penetrates through the upper surface 28 and into the bore 29. A support arm 32 at one end thereof is rotatably received by the bore 29, and the tightening screw 31 is movable to engage and secure the arm 32 within the bore 29. The arm 32 extends upwardly from the block 27 at an angle to the surface 28 to terminate in an upper end having a slot 33 formed therein. The plane 23, adjacent the edge which is opposite the edge of attachment to the plane 19, is slidably received within the slot 33. The plane 23 is pivotally attached to the arm 32 by a bolt 34 and secured in a desired orientation, as by means of a wing nut 36.

Figure 7:
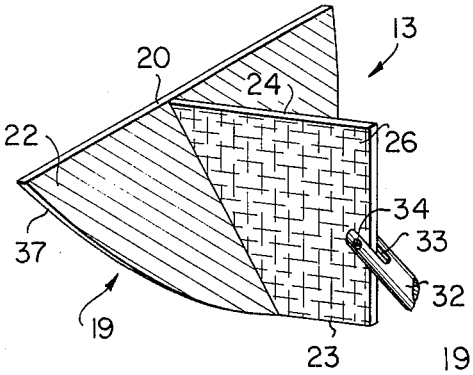
FIG. 7 is a fragmentary, perspective view of a modification of the second embodiment of the analyzer.

The second embodiment of the analyzer of this invention 11 may be modified. The plane 19 may be semi-circular in conformation, retaining the upper edge 20 and having a lower, arcuate edge 37, as shown in FIG. 7. The arm 32 may be upwardly arcuate in conformation, the radius of curvature thereof being taken from a center point located below the arm 32.

Figure 4:
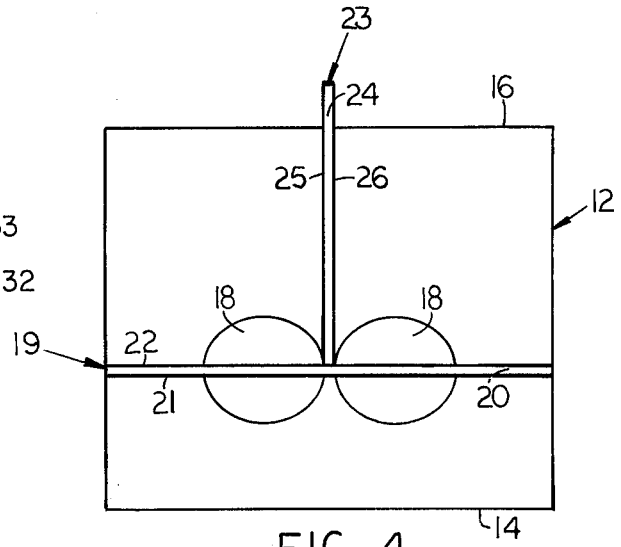
FIG. 4 is a top perspective view of the first embodiment of the analyzer depicting the proper sighting taken by a golfer using the analyzer.
Figure 6:
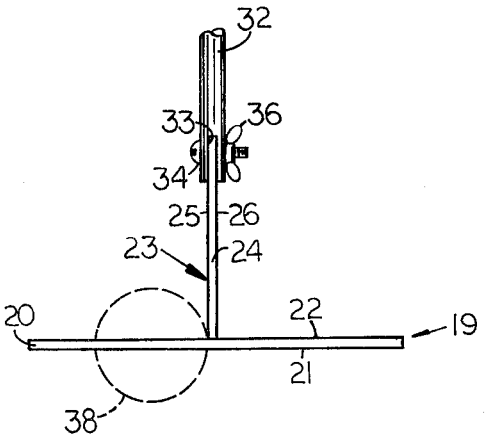
FIG. 6 is a fragmentary, top perspective view of the second embodiment of the analyzer depicting the proper sighting taken by a golfer using the analyzer.

Use of the analyzer of this invention 11 is illustrated in FIGS. 4 and 6. If the golfer-user is practicing indoors at home, the first embodiment of the analyzer 11, shown in FIGS. 1 through 4, is used. If the golfer-user is practicing outdoors or any place where he may swing a golf club to strike a ball 38, the second embodiment of the analyzer 11, shown in FIGS. 5 and 6, is used.

Where the first embodiment of the analyzer 11 is used, the golfer-user places the analyzer in a appropriate place, the bottom 16 engaging the floor, and assumes his regular golfing stance. The golfer uses one of the areas 18 as a simulation of an actual golf ball, right-handed golfers concentrating on the area 18 which is disposed to the left of plane 23 fronting upon side 25, left-handed golfers concentrating on the area 18 which is disposed to the right of plane 23 fronting upon side 26. The golfer takes a stance whereby he is facing the front edge 14 and surface 21, and he should see the top edges 20, 24 only and not the sides 21, 22, 25, 26, FIG. 4 illustrates the view which the golfer should have when he has assumed his proper stance for addressing the ball. It will be noted that the edges 20, 24 by their intersection direct the golfer to concentrate on the position upon the golf ball, here simulated by one of the areas 18, which the head of a club should strike with a correct swing.

The golfer then practices his swing while noting which colors he sees during his swing. If the golfer sees blue (front side 21), he is either leaning backwards or lowering his head during his swing. If the golfer sees green (rear side 22), he is leaning forward or raising his head during his swing. Should the golfer see yellow (right side 26) or orange (left side 25), he is swaying his body to the right or left during his swing. A combination of colors would indicate some combination of the aforementioned movements.

In general, cool colors (blue, green) indicate forward and backward movements while hot colors (orange, yellow) indicate sideways movements. The colors of the planes 21, 22, 25, 26 are contrasting and are very visible against the black color of the surface 17. By analyzing the colors which become visible to him during his swing, the golfer can correct his stance and swing such that he properly addresses and strikes a golf ball. During a proper swing, the golfer should see nothing other than the top edges 20, 24 marking the rear edge of a simulated ball area 18 against the black background of the surface 17.

While the golfer uses the first analyzer 11, shown in FIGS. 1 through 4, where he is practicing his swing without using a golf club or ball, the second analyzer 11, shown in FIGS. 5 and 6, is used where the golfer actually uses his clubs and strikes a ball 38. As before, the golfer places the ball 38 and assumes his stance, addressing the golf ball 38 in his normal manner. The arm 32 displaces the indicator mechanism 13 forward of the base assembly 12' such that a golf ball 38 may be placed upon the ground and struck with a golf club without the club striking the analyzer 11. Where the plane 19 having the arcuate edge 37 is employed, passage of the club beneath the indicator mechanism 13 is further facilitated. As shown in FIG. 6 (the case of a right-handed golfer being illustrated), the golfer should see the edges 20, 24, and his attention should be focused upon the rear edge of the golf ball 38, to which the intersection of the edges 20, 24 direct. As before, the golfer takes note of the colors he sees while swinging to strike the ball 38. He then analyzes the colors to ascertain bodily movements by him which must be eliminated in order to properly swing and strike the ball 38.

The 65° angle of the transverse plane 20 with respect to the surface 17 is suited to most persons when using a driver. When assuming a normal correct stance, the golfer will see the analyzer 11 as shown in FIG. 4. For persons taller than about 6'3" (190 cms), or where clubs of short lengths and greater loft such as seven, eight and nine irons and pitching and sand wedges are used, the angle should be greater than 65°. For persons shorter than about 5'7" (170 cms) the angle should be smaller than 65°. Separate forms of the analyzer 11 can be used by different height groupings of golfers or for different club lengths by each individual golfer. Alternately, shims (not shown may be placed underneath the base 12 adjacent the front edge 14 or rear edge 15 to change the angle of the plane 19 with respect to the floor. The seccond form of analyzer 11, shown in FIGS. 5 and 6, has an indicator mechanism 13 which can be adjusted such that the angle which the plane 19 makes with respect to the ground is either about 65° or is greater or less than 65°.

During the foregoing description concerning the angle of the plane 19, it has been assumed that the golfer is using a normal golf stance. For those instances where an individual golfer through study and instruction has developed an unusual golf stance, the correct angle of the plane 19 is determined by the golfer first assuming his stance. A second person then adjusts the analyzer 11 such that the golfer views the edges 20, 24 as shown in FIG. 4 or FIG. 6. Notice is then taken of how the analyzer 11 is adjusted, and thereafter the golfer himself may set up the analyzer whenever he desires to practice his swing.

From the foregoing it can be seen that both forms of the analyzer 11 can be used by golfers of any height with clubs of any particular loft. The individual golfer can self-determine through use of the analyzer 11 any deviation of his head during the course of his swing. Movements of the head are detected at the moment of occurrence during the swing. The individual can determine corrections to be made to his swing in order to obtain a steady head. More cumbersome methods, whereby a second individual places his hand upon the head of the golfer to teach the golfer to keep his head steady or merely watches and then communicates his observations to the golfer, are thereby eliminated. The golfer, by using different embodiments of the analyzer 11, may practice his swing virtually anywhere. Thus it can be seen that the objects of this invention have been attained.

Although two embodiments of the self-instruct golf analyzer 11 have been disclosed herein, it is to be remembered that various modifications and alternate constructions can be made thereto without departing from the full scope of the invention, as defined in the appended claims.

I claim:

1. A self-instruct golf swing analyzer for use by a golfer, said analyzer comprising:

a base means having a lower ground engageable portion and an upper portion; and an indicator means for communicating to the golfer the body movement of the golfer during a golf swing, said indicator means being attached to said upper portion and including first and second planar indicator members, said second planar indicator member being affixed normal to said first planar indicator member intermediate the ends of said first planar indicator member, the opposite planar surfaces of said planar members including markings distinctly different from one another and detectable by a golfer from a golfing stance upon improper head and body movement during the execution of a golf club swing the golfer assuming a stance adjacent said base means and fixing his gaze upon said indicator members.

2. A self-instruct golf swing analyzer as defined in claim 1 and further wherein said upper portion of said base means is flat, said second planar indicator member being affixed normal to said upper portion, said first planar indicator member being affixed to said upper portion oblique thereto.

3. A self-instruct golf swing analyzer as defined in claim 2 and further wherein said upper portion includes formed thereon a pair of area means for simulating a golf ball, said first planar indicator member being affixed to said upper portion directly over said area means to bisect both said area means, said second planar indicator member being affixed to said upper portion and passing directly between said pair of area means and tangential to both said area means.

4. A self-instruct golf swing analyzer as defined in claim 2 and further wherein said first and second planar indicator members have first and second upper edges respectively, said first planar indicator member having front and rear surfaces, said second planar indicator member having right and left surfaces, said first and second edges forming an inverted T-shape and said front, rear, left and right surfaces not being visible when said indicator members are gazed at by the golfer after the golfer has assumed a stance.

5. A self-instruct golf swing analyzer as defined in claim 2 and further wherein said first planar indicator member has front and rear surfaces, said second planar indicator member having right and left surfaces, said front, rear, right and left surfaces and said upper portion each bearing a color, each of said colors being different from the rest of said colors.

6. A self-instruct golf swing analyzer as defined in claim 1 and further wherein said upper portion of said base means is an elongated arm member, said arm member being attached to and extending upwardly from said lower ground-engageable portion at an angle thereto, said arm member having an upper end, said indicator means being pivotally attached at said upper end, said second planar indicator member defining a plane normal to the ground, said first planar indicator member defining a plane oblique to the ground.

7. A self-instruct golf swing analyzer as defined in claim 6 and further wherein said first and second planar indicator members have first and second upper edges respectively, said first planar indicator member having front and rear surfaces, said second planar indicator member having right and left surfaces said first and second edges forming an inverted T-shape and said front, rear, left and right surfaces not being visible when said planar indicator members are gazed at by the golfer after the golfer has assumed a stance, said first and second upper edges intersecting at a point marking the rear edge of the golf ball, said first edge bisecting the golf ball and said second edge being tangential to the golf ball.

8. A self-instruct golf swing analyzer as defined in claim 7 and further wherein said first planar indicator member has front and rear surfaces, said second planar indicator member having right and left surfaces, said front, rear, right and left surfaces each bearing a different color, each of said colors being different from the rest of said colors.

9. A self-instruct golf swing analyzer as defined in claim 6 and further wherein said first planar indicator member has an upper straight edge and a lower arcuate edge, said first planar indicator member thereby assuming the shape of a half-circle.

* * * * *